US005595402A

United States Patent [19]

Omori

[11] Patent Number: 5,595,402

[45] Date of Patent: Jan. 21, 1997

[54] PSYCHOLOGICAL TEST PAPER

[76] Inventor: Mitsuko Omori, 17-67, Mondoso, Nishinomiya-shi, Hyogo 662, Japan

[21] Appl. No.: 386,855

[22] Filed: Feb. 10, 1995

Related U.S. Application Data

[63] Continuation of Ser. No. 151,411, Nov. 12, 1993, abandoned.

[51] Int. Cl.[6] ..... B42D 15/00

[52] U.S. Cl. ..... 283/67; 283/45

[58] Field of Search ..... 283/17, 44, 45, 283/46, 48.1, 117, 67; 281/2

[56] References Cited

U.S. PATENT DOCUMENTS 1,867,511 7/1932 Kinnaird .
1,883,775 10/1932 Finkenbinder .
4,604,063 8/1986 Gurmarnik ..... 434/157

*Primary Examiner*—Willmon Fridie, Jr.
*Attorney, Agent, or Firm*—Hamilton, Brook, Smith & Reynolds, P.C.

[57] ABSTRACT

A novel psychological test paper utilizable for the assessment of the psychology of a subject being tested with respect to his or her past, present or future perspective comprises a sheet of paper having a unique physical pattern of first to sixth blank areas depicted thereon. Each of the first to sixth blank areas is delimited by a delineated contour. The physical pattern is such that the second to sixth blank areas are depicted on top, left-hand side, right-hand side, diagonally lower left-hand and diagonally lower right-hand sides of the first blank area, respectively. The blank areas on the test paper are utilized to be selectively colored by a subject to be tested in different colors during a psychological test. The psychology of the subject is assessed by reference to which blank areas are colored in what color, the sequence of coloring and/or the manner of coloring.

8 Claims, 3 Drawing Sheets

PSYCHOLOGICAL TEST PAPER

This application is a continuation of co-pending application Ser. No. 08/151,411 filed Nov. 12, 1993, which is incorporated herein by reference in its entirety.

BACKGROUND OF THE INVENTION

1. Field of the Invention

The present invention relates to a psychological test paper utilizable for the assessment of past, present and/or future psychological conditions such as, for example, personality, of a person being tested.

2. Description of the Prior Art

Psychological testing methods now in use are many, but no psychological testing method effective to assess past, present and/or future psychological conditions of a person being tested has yet been made available up to date. Although, for example, the Japanese Examined Utility Model Publication No. 63-40969, published in 1988, discloses a handy psychological test paper, this known test paper is merely used to assess the development of intelligence of a child.

SUMMARY OF THE INVENTION

The present invention is intended to provide a novel psychological test paper utilizable for the assessment of past, present and/or future of psychological conditions of a person being tested with no need to employ any complicated technique.

According to the present invention, there is provided a sheet of paper having a unique physical arrangement of first to sixth blank areas depicted thereon, each of said first to sixth blank areas being delimited by a delineated contour. The physical arrangement is such that the second to sixth blank areas are depicted on top, left-hand side, right-hand side, diagonally lower left-hand and diagonally lower right-hand sides of the first blank area, respectively.

The blank areas on the test paper are utilized to be selectively colored by a subject (a person being tested) in different colors during a psychological test. More specifically, when the psychological test is to be performed, the subject is presented the novel psychological test paper and is asked to color some or all of the blank areas on the test paper, a psychologist or counselor should start the test on the premises that, due to the physical arrangement of the first to sixth blank areas depicted on the novel test paper, the subject looking at the novel test paper will associate the first blank area with what he or she has in mind at the time of test, the second blank area with what he or she will be in the future, the third and fourth blank areas with current circumstances in which he or she is currently placed, and the fifth and sixth blank areas with what he or she had been in the past.

After the subject has colored the first to six blank areas on the novel test paper, the psychologist or counselor evaluates the test paper having been colored by the subject for the assessment of his or her past, present and/or future psychological conditions. For example, if the subject has colored the second blank area in red color, the psychologist or counselor may well determine that he or she would be a man of ambition towards the future.

With the novel test paper according to the present invention, the sequence of coloring of the first to sixth blank areas, that is, the order of coloring in which the subject has colored the first to sixth blank areas, can provide a cue for the assessment of the subject's psychological conditions. For example, if the subject colors the second blank area the first thing to do, the subject may be assessed as having a future-oriented personality.

Also, the manner in which the first to sixth blank areas on the novel test paper is colored can provide a cue for the assessment of the subject's psychological conditions. By way of example, if the subject colors all of the first to sixth blank areas evenly solid, the subject may be assessed a man of great tenacity.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
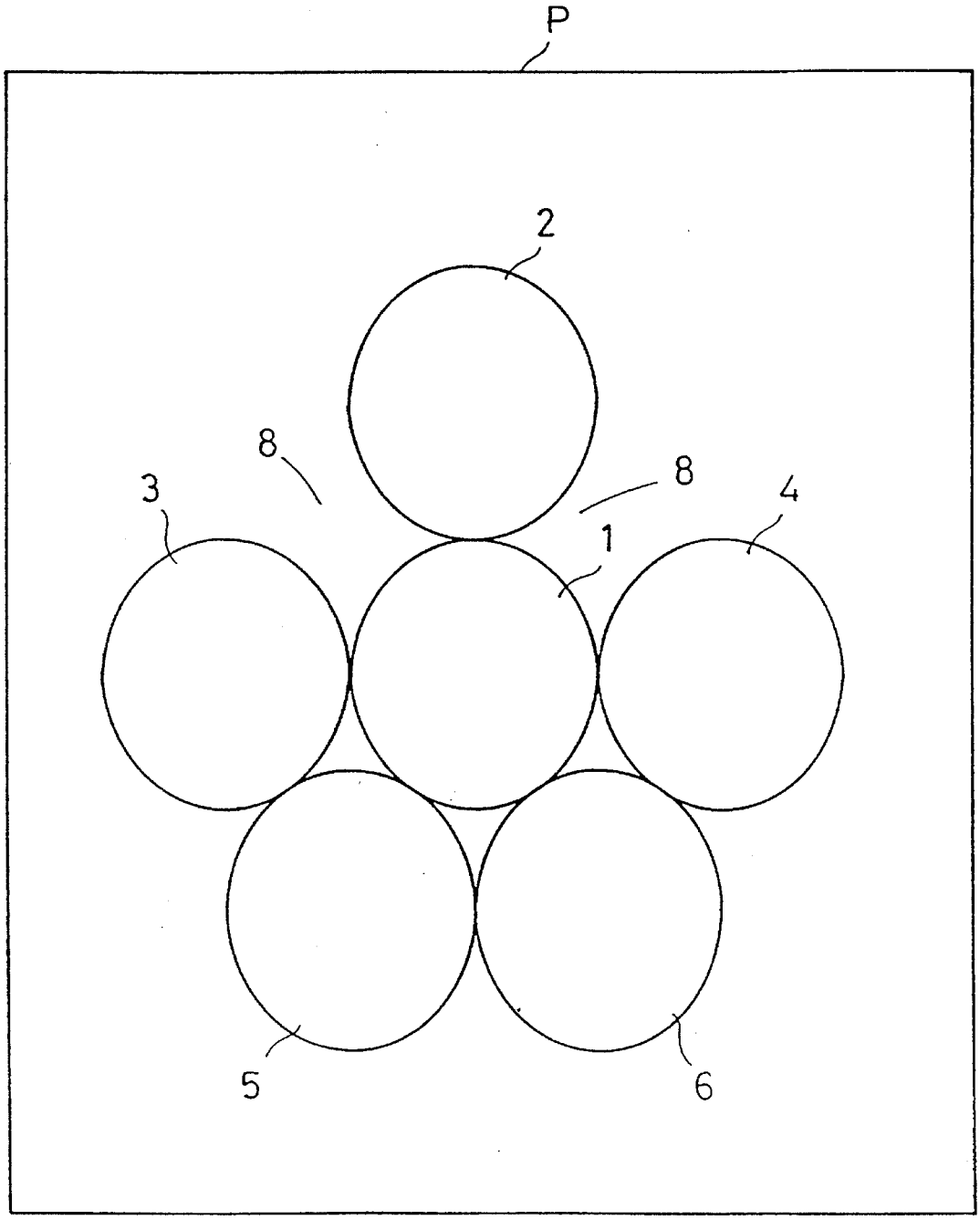
FIG. 1 is a plan view of a novel psychological test paper according to a first preferred embodiment of the present invention.

Referring first to FIG. 1, a novel psychological test paper according to the present invention comprises a generally oblong sheet of paper P having one of its opposite side depicted with a physical pattern of first to sixth blank areas 1 to 6 each delimited by a delineated contour. The physical pattern is such that, while the first blank area 1 is positioned inside and surrounded by a generally round rows of the second to sixth blank areas 2 to 6, the second to sixth blank areas 2 to 6 are depicted on top, left-hand side, right-hand side, diagonally lower left-hand and diagonally lower right-hand sides of the first blank area 1, respectively.

Each of the blank areas 1 to 6 depicted on the sheet of paper P may be of any shape, provided that the respective blank area 1 to 6 can signify the area in which coloring is to be made. Each blank area 1 to 6 may represents a round, oval, elliptical, triangular or rectangular shape, or any other shape defining the area in which coloring is to be made. In the illustrated embodiment, each blank area 1 to 6 represents an elliptical shape having a ratio of the long axis thereof relative to the short axis thereof being chosen to be 1:0.9. However, where the elliptical shape is chosen for the shape of each blank area 1 to 6, the ratio of the long axis relative to the short axis may be chosen to be smaller than 1/0.7 and greater than 1/1.

Figure 2A:
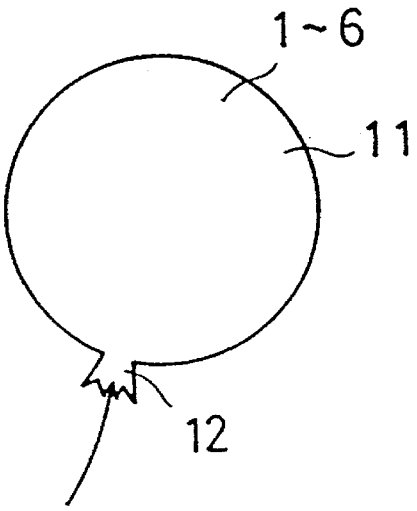
FIGS. 2(*a*) and 2(*b*) are diagrams showing different contours of one of blank areas depicted on the novel psychological test paper, respectively.
Figure 2B:
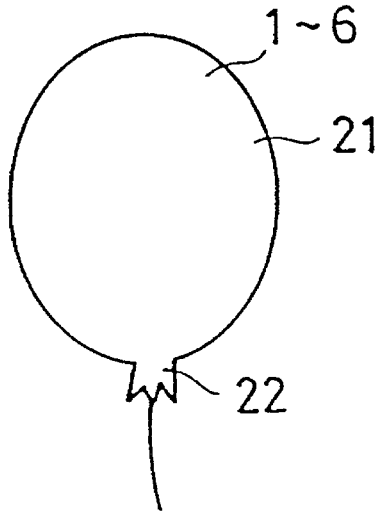

More specifically, although FIG. 2(*a*) illustrates a balloon 11, the illustrated balloon 11 represents in a plan view a round shape combined with a shape of the blow-in mouth 12 and, however, the shape of the illustrated balloon 11 as a whole can be perceived as a generally round shape. Similarly, although FIG. 2(*b*) illustrates a balloon 21, the illustrated balloon 21 represents in a plan view an elliptical shape combined with shape of the blow-in mouth 22 and, however, the shape of the illustrated balloon 21 as a whole can be perceived as a generally elliptical shape.

Figure 3:
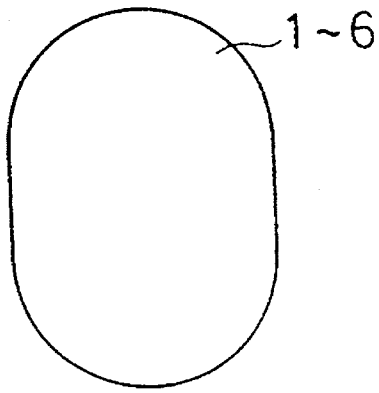
FIG. 3 is a diagram showing a further different contour of one of the blank areas depicted on the novel psychological test paper.

In view of the foregoing, for the purpose of the present invention, the term "round" is to be understood as including a right round shape, a substantially round shape and a generally round shape combined with any other shape which is so minor that the subject may perceive it as a round shape as discussed with reference to FIG. 2(*a*). Similarly, the term "elliptical" is to be understood as including a right elliptical shape, a substantially elliptical shape and a generally elliptical shape mixed with any other shape which is so minor that the subject may perceive it as an elliptical shape as discussed with reference to FIG. 2(*b*). It is also to be noted that such a shape as shown in FIG. 3 which comprises parallel straight line segments and arcuate line segments continued to respective ends of the straight line segments is indeed perceived as and should therefore be understood as included in the concept of elliptical shape.

Referring again to FIG. 1, the second to sixth blank areas 2 to 6 are shown as having their perimeters adjoining the perimeter of the first blank area 1 while the perimeter of the third blank area 3 adjoins the perimeter of the fifth blank area 5 which in turn adjoins the perimeter of the fourth blank area 4 through the sixth blank area 6. However, in the practice of the present invention, they may be separated a slight distance from each other. Also, although in FIG. 1 the second blank area 2 is shown as separated from any one of the third and fourth blank areas 3 and 4 with a space 8 intervening therebetween, the presence of the space 8 between the second blank area 2 and any one of the third and fourth blank areas 3 and 4 is not always essential and may therefore be dispensed with to allow the perimeter of the second blank area 2 to adjoin the perimeter of any one of the third and fourth blank areas 3 and 4.

Although not essential in the practice of the present invention and therefore not limited thereto, the physical pattern of the first to sixth blank areas 1 to 6 is preferably chosen to resemble an abstract representation of the human body so that a subject to be tested can readily grasp an impression of man. Hence, in the physical pattern shown in FIG. 1, the first blank area 1 represents body; the second blank area 2 represents head; the third and fourth blank areas 3 and 4 represents left-hand and right-hand upper limbs; and the fifth and sixth blank areas 5 and 6 represents left-hand and right-hand lower limbs.

Figure 4:
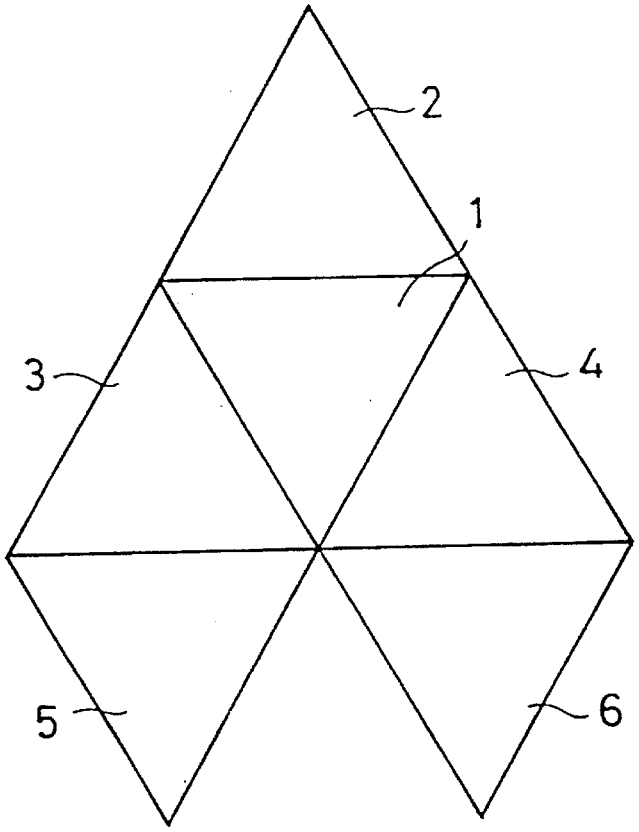
FIG. 4 is a diagram showing a different physical arrangement of the blank areas according to a second preferred embodiment of the present invention which are to be depicted on a sheet of paper.
Figure 5:
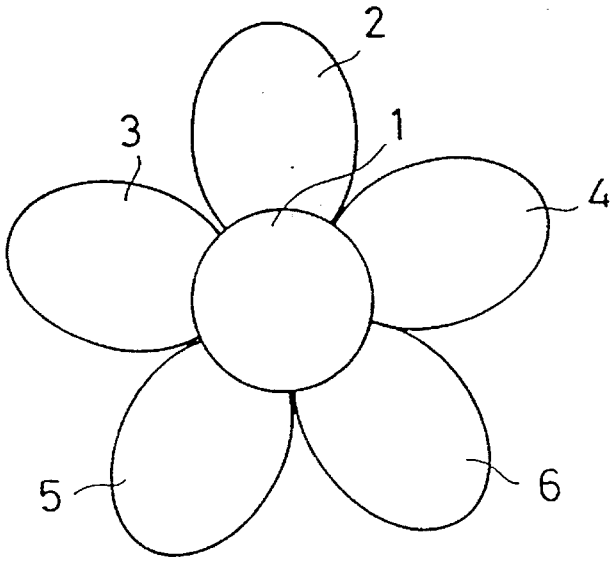
FIG. 5 is a diagram showing a further different physical arrangement of the blank areas according to a third preferred embodiment of the present invention which are to be depicted on a sheet of paper.

Alternatively, the physical pattern of the first to sixth blank areas 1 to 6 may be chosen to resemble the shape of an inverted figure of "V" as shown in FIG. 4 or an abstract representation of a flower as shown in FIG. 5.

According to the embodiment shown in FIG. 4, the first to sixth blank areas 1 to 6 each being of a triangular shape are so positioned as to represent the required physical pattern. Namely, the second to sixth blank areas 2 to 6 are depicted on top, left-hand side, right-hand side, diagonally lower left-hand and diagonally lower right-hand sides of the first blank area 1, respectively.

According to the embodiment shown in FIG. 5, while the first blank area 1 is of a shape representing a flower core, each of the second to sixth blank areas 2 to 6 is of a shape generally similar to a flower petal and the combination thereof surround the first blank area 1, thereby permitting the physical pattern as a whole to resemble a flower. Even in this embodiment, the second to sixth blank areas 2 to 6 are depicted on top, left-hand side, right-hand side, diagonally lower left-hand and diagonally lower right-hand sides of the first blank area 1, respectively.

In the practice of the present invention, instead of the oblong paper referred to above, any sheet of any suitable shape may be employed as material for the test paper. For example, a sheet or board of plastic material or wooden material may also be employed for bearing the physical pattern of the first to sixth blank areas 1 to 6 thereon.

When a psychological test is to be performed using the novel test paper P according to the present invention, a subject to be tested has to be given color writing instruments, for example, a set of 12 color pastel crayons or color pencils and is then asked to color the test paper P. When coloring the test paper P, the subject looking at the novel test paper P will associate the first blank area with what he or she has in mind at the time of test, the second blank area with what he or she will be in the future, the third and fourth blank areas with current circumstances in which he or she is currently placed, and the fifth and sixth blank areas with what he or she had been in the past. The test paper P according to the present invention is so featured as to allow the subject to acquire such an association. Depending on the psychology of the subject, the subject will choose some or all of the first to sixth blank areas 1 to 6 and then color them with some of the color pastel crayons. Assessments of the psychological conditions of the subject is made using the following charts.

Psychological Assessment Chart

| Colored Area | Color Used | Assessment of What Subject Feels |
|---|---|---|
| Area 1 | Warm Color | Confident of the present positive attitude. |
| | Cold Color | Confident of the present conservative attitude. |
| Area 2 | Warm Color | Practical or ambitious to carve out a career for the future. |
| | Cold Color | Conservative of the current attitude towards the future. |
| Areas 3, 4 | Warm Color | Well adapted to the present circumstances. |
| | Cold Color | Less adapted to the present circumstances. |
| Areas 5, 6 | Warm Color | Satisfied with the past circumstances. |
| | Cold Color | Concerned with the past circumstances. |

In general, it is considered that preference of the warm color including shades of red reflects a psychologically positive and/or practice attitude of the subject whereas preference of the cold color including shades of blue reflects a psychologically conservative attitude of the subject. Accordingly, the psychological assessment chart tabulated above is empirically determined by evaluating a combination of colors used to color some or all of the first to sixth blank areas 1 to 6 on the test paper P.

The psychological conditions of a subject being tested can also be determined by reference to the sequence of coloring in which the subject has colored the first to sixth blank areas 1 to 6 on the test paper P. It has been found at a high match rate that most persons who are generally considered psychologically future-oriented start coloring from the second blank area 2; that most persons who are generally considered psychologically conservative of the current situations start coloring from the first area 1; and that most persons who are generally considered psychologically concerned with the past start coloring from the fifth or sixth area 5 or 6. Therefore, the reverse to this finding may be utilized to assess the psychology of a subject being tested on the basis of the sequence of coloring on the test paper P.

Information on the manner in which the first to sixth blank areas 1 to 6 on the novel test paper P is colored may also be used as a cue for the assessment of the subject's psychological conditions. This is based on the finding that most persons who color all of the first to sixth blank areas 1 to 6 evenly solid are generally considered of a considerably tenacious character, whereas most persons who color them roughly are generally considered of a smart character. Thus, the reverse to this finding may be utilized to assess the psychology of a subject being tested on the basis of the manner in which the first to sixth blank areas 1 to 6 on the test paper P.

It is also pointed out that most persons who color one or all of the spaces 8 between the second blank area 2 and the third blank area 3 and between the second blank area 2 and the fourth blank area 4 as shown in FIG. 1 are generally considered non-stereotyped and, therefore, if he or she color the space or spaces 8, he or she may be so assessed.

From the foregoing description, the test paper according to the present invention is indeed a handy instrument to determine or assess the psychology, including the personality, of a subject being tested with respect to his or her past, present or future perspective. The test paper according to the present invention can be advantageously utilized by not only a psychologist, but also a counselor who is engaged in, for example, employee recruitment.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A method of testing a psychological condition of a subject to be tested comprising the steps of:

providing the subject with a psychological test paper which comprises a sheet having a pattern consisting essentially of first to sixth blank areas depicted thereon to be colored, each of said first to sixth blank areas being defined by respective contours, said pattern being such that the second to sixth blank areas are positioned relative to the first blank area on the top, left-hand side, right-hand side, diagonally lower left-hand and diagonally lower right-hand sides of the first blank area, respectively, the first blank area being substantially centrally positioned relative to the second through sixth blank areas, wherein the respective contours of the second to sixth blank areas adjoin the contour of the first blank area;

having the subject color some or all of the first to sixth blank areas, wherein one or more of the areas to be colored are associated with the present, past and/or future; and evaluating the colored test paper to assess one or more of past, present or future psychological conditions of the subject wherein the evaluating step comprises one or more of the following:

(a) evaluating the order of coloring of at least two areas;

(b) evaluating the color of at least one area;

(c) evaluating the presence or absence of coloring of at least one area; and (d) evaluating the manner of coloring of at least one area.

2. The method of claim 1 wherein the contours of the respective first to sixth blank areas are generally elliptical in shape.

3. The method of claim 2 wherein the elliptical shape has long and short axes, the ratio of the long axis relative to the short axis being smaller than 1/0.7 and greater than 1/1.

4. The method of claim 1 wherein the contours of the respective first to sixth blank areas are generally round in shape.

5. The method of claim 1 wherein the contour of the second blank area is separated from any one of the contours of the respective third and fourth blank areas.

6. The method of claim 1 in which the step of evaluating the colored test paper comprises the step of evaluating the order of coloring in which the subject has colored the blank areas on the test paper to assess one or more of past, present or future psychological conditions of the subject.

7. The method of claim 1 in which the step of evaluating the colored test paper comprises the step of evaluating the manner in which the blank areas on the test paper have been colored by the subject to assess one or more of past, present or future psychological conditions of the subject.

8. A method of testing a psychological condition of a subject to be tested comprising the steps of:

a) providing the subject with a psychological test paper which comprises a sheet having a pattern consisting essentially of first to sixth blank areas depicted thereon to be colored, each of said first to sixth blank areas being defined by respective contours, said pattern being such that the second to sixth blank areas are positioned relative to the first blank area on the top, left-hand side, right-hand side, diagonally lower left-hand and diagonally lower right-hand sides of the first blank area, respectively, the first blank area being substantially centrally positioned relative to the second through sixth blank areas, wherein the respective contours of the second to sixth blank areas adjoin the contour of the first blank area; and b) having the subject color some or all of the first to sixth blank areas, the subject coloring the first blank area while associating what the subject has in mind at the time of the test, the second blank area with what the subject will be in the future, the third and fourth blank areas with current circumstances in which the subject is currently placed, and the fifth and sixth blank areas with what the subject has been in the past, and evaluating the colored test paper to assess one or more of past, present or future psychological conditions of the subject, wherein the evaluating step comprises one or more of the following:

(a) evaluating the order of coloring of at least two areas;

(b) evaluating the color of at least one area;

(c) evaluating the presence or absence of coloring of at least one area; and (d) evaluating the manner of coloring of at least one area.

* * * * *